US006838809B2

(12) United States Patent
Nasu et al.

(10) Patent No.: US 6,838,809 B2
(45) Date of Patent: Jan. 4, 2005

(54) CHROMATE FILM-CONTAINING PLUG METAL COMPONENT AND METHOD FOR PRODUCING THE SAME

(75) Inventors: Hiroaki Nasu, Aichi (JP); Wataru Matsutani, Nagoya (JP); Makoto Sugimoto, Nagoya (JP); Mitsuru Yoshida, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 10/292,455

(22) Filed: Nov. 13, 2002

(65) Prior Publication Data

US 2003/0214208 A1 Nov. 20, 2003

(30) Foreign Application Priority Data

Nov. 13, 2001 (JP) ..... P.2001-347451
Sep. 11, 2002 (JP) ..... P.2002-265796

(51) Int. Cl.[7] ..... H01T 13/20
(52) U.S. Cl. ..... 313/141; 313/143
(58) Field of Search ..... 313/118, 141–143; 445/7

(56) References Cited

U.S. PATENT DOCUMENTS

| | | | | |
|---|---|---|---|---|
| 4,967,116 | A | 10/1990 | Oshima | |
| 6,096,140 | A | 8/2000 | Susa et al. | |
| 6,236,148 | B1 * | 5/2001 | Nasu et al. | 313/141 |
| 6,287,704 | B1 | 9/2001 | Preikschat et al. | |
| 2001/0050522 | A1 | 12/2001 | Nasu et al. | |
| 2003/0207133 | A1 | 11/2003 | Preikschat et al. | |

FOREIGN PATENT DOCUMENTS

| | | | |
|---|---|---|---|
| DE | 196 15 664 | A1 | 10/1997 |
| DE | 19638176 | A1 | 4/1998 |
| EP | 1 032 100 | A2 | 8/2000 |
| GB | 2 078 261 | A | 1/1982 |
| JP | 61 587 | A | 6/1986 |
| JP | 7 126859 | A | 5/1995 |
| JP | 10 183364 | A | 7/1998 |
| JP | 2000 48980 | | 2/2000 |
| JP | 2000 509434 | A | 7/2000 |
| JP | 2000 234177 | A | 8/2000 |
| JP | 2000 249340 | A | 9/2000 |
| JP | 2000 252042 | A | 9/2000 |

OTHER PUBLICATIONS

Electronic, Chemical Plating & Engineering Guide: Plating Technology Guide; Federation of Electro Plating Industry Associate, Japan; pp. 358–464.

* cited by examiner

*Primary Examiner*—Vip Patel
*Assistant Examiner*—Anthony Perry
(74) *Attorney, Agent, or Firm*—Sughrue Mion, PLLC

(57) ABSTRACT

A chromate film-containing plug metal component which is a metal component for a spark plug or a glow plug, wherein: the metal component has a surface, at least part of the surface being coated with a chromate film comprising at least 95% by weight of trivalent chrome based on 100% by weight of a total chrome content in the chromate film; and the chromate film comprises dye particles.

2 Claims, 6 Drawing Sheets

CHROMATE FILM-CONTAINING PLUG METAL COMPONENT AND METHOD FOR PRODUCING THE SAME

FIELD OF THE INVENTION

The present invention relates to a chromate film-containing plug metal component which contains a chromate film formed on at least one part of its surface, and to a method for producing the metal component.

BACKGROUND OF THE INVENTION

To prevent corrosion of a metal component, a surface of the metal component is often plated and further coated with a chromate film. A colored chromate film as one of such chromate films is used in a wide field because the colored chromate film is excellent in corrosion resistance. A lot of chromate films excellent in corrosion resistance as well as the colored chromate film have not been, however, used intentionally from the point of view of environmental protection because they have a tendency to contain hexavalent chrome. Hereinafter, a chromate film substantially containing hexavalent chrome is also referred to as "hexavalent chromate film".

To solve this problem, the present inventors have developed a chromate film substantially containing no hexavalent chrome but containing trivalent chrome as a large part of chrome component. Hereinafter, such a chromate film is also referred to as "trivalent chromate film". The present inventors have succeeded in keeping corrosion resistance good by making the chromate film thick. As described above, use of the trivalent chromate film in place of the hexavalent chromate film has been advanced as use of hexavalent chrome has been substantially limited in the world.

On the other hand, the trivalent chromate film is often applied on a metal component for a plug such as a spark plug or a glow plug. Corrosion resistance at a temperature higher than ordinary temperature becomes a subject of discussion because such a plug is used after attached to an internal combustion engine. The present inventors have developed a trivalent chromate film having corrosion resistance kept good even at a high temperature and have prepared the spark plug or glow plug having such a chromate film formed thereon as disclosed in JP-A-2000-252042 (the term "JP-A" as used herein means an "unexamined published Japanese patent application") JP-A-2000-249340, etc.

SUMMARY OF THE INVENTION

The hexavalent chromate film inclusive of the colored chromate film, however, can exhibit various color tones when the amount of hexavalent chrome dispersively contained in the film and the thickness of the film are changed. It is, however, impossible to make the trivalent chromate film exhibit the same various color tones as those exhibited by the hexavalent chromate film because it is difficult to adjust the thickness of the trivalent chromate film. For this reason, it is difficult to distinguish one component itself from another by color tone or to identify information of the component such as discrimination between left and right by color tone even in the case where the trivalent chromate film is applied on a plug metal component.

An object of the invention is to provide a metal component for a chromate film-containing plug, which is covered with a chromate film substantially containing no hexavalent chrome and which can be identified by color tone, and to provide a method for producing the metal component.

To solve the problem, in accordance with the invention, there is provided a chromate film-containing plug metal component which is a metal component for a plug such as a spark plug or a glow plug, wherein: the metal component has at least one part of a surface coated with a chromate film containing 95% or more by mass of trivalent chrome with respect to the total chrome content; and the chromate film contains dye particles.

In the configuration of the invention, a chromate film containing 95% or more by mass of trivalent chrome with respect to the total chrome content is formed on at least one part of a surface of the plug metal component. That is, the chromate film according to the invention contains a small amount of hexavalent chrome, e.g., 5% or less by mass of hexavalent chrome with respect to the total chrome content compared with an ordinary colored chromate film containing about 25% to 35% by weight (% by mass) of hexavalent chrome with respect to the total chrome content. Hence, the chromate film according to the invention can meet the environmental requirement for reduction in hexavalent chrome. Preferably, the chromate film contains 98% or more by mass of trivalent chrome with respect to the total chrome content. More preferably, the chromate film contains substantially no hexavalent chrome component. Incidentally, the phrase "substantially no hexavalent chrome component" means that no hexavalent chrome component is detected when analysis is made by an X-ray photoelectron spectroscopy (XPS).

Moreover, because the chromate film contains dye particles dispersed therein, the chromate film can exhibit a color tone without any change in the thickness of the chromate film even in the case where the chromate film contains little hexavalent chrome. The reason why the chromate film can exhibit a color tone is that light in a specific wavelength range in a visible region is absorbed to the dye particles. Hence, when the constituent members of the dye particles are changed to thereby change the wavelength range of the absorbed light, various color tones can be generated. Hence, even a plug metal component covered with a trivalent chromate film can be distinguished from another plug metal component by the color tone. Moreover, when the color tones of parts in the component are changed, information such as left and right of the component can be identified. Incidentally, because the inside of the chromate film is impregnated with the dye particles, there is no disadvantage that the color tone of the plug metal component may be lightened due to friction with another component.

Preferably, the invention may be applied to the case where the chromate film has a thickness ranging from 0.2 $\mu$m to 0.5 $\mu$m. Particularly, a plug used for ignition in an internal combustion engine, such as a spark plug or a glow plug, needs high corrosion resistance because of the environment of use thereof at a high temperature or attack due to an acid component. The present inventors have succeeded in forming a thick chromate film having the thickness in a plug metal component in order to improve corrosion resistance. The formation of such a thick chromate film, however, brings a structure in which the film hardly contains other components such as dye particles because corrosion resistance of the film is improved but the structure of the film becomes denser. In the invention, however, dye particles are contained in a trivalent chromate film having a dense structure and formed on a metal component for a plug such as a spark plug or a glow plug particularly needing high corrosion resistance. As a result, even the trivalent chromate film good in corrosion resistance can exhibit a color tone. Hence, the range of use of the trivalent chromate film can be widened, so that the invention has a large industrial effect. Incidentally, if the chromate film is thinner than 0.2 μm, both corrosion resistance and heat resistance cannot be kept sufficient. Moreover, there is a disadvantage in that the space of immersion in the dye is reduced so that sufficient color tone cannot be exhibited. If the thickness is larger than 0.5 μm, the film is apt to crack (for example, at the time of processing in assembling of the component with another component), or the film is apt to drop out so that corrosion resistance may be spoiled. Preferably, the thickness of the chromate film is set to be in a range of from 0.3 μm to 0.5 μm. In the thickness range, durability of the plug component can be kept sufficient even in the environment of use peculiar to the plug that the temperature tends to rise and the plug is apt to suffer acid attack due to exhaust gas components ($CO_2$, $NO_x$).

The dye particles contained in the inside of the chromate film may contain a polar molecular compound. The trivalent chromate film is very dense, so that the film is consequently excellent corrosion resistance. According to the inventors' examination, it has been, however, found that the denseness of the film becomes a barrier to permeability of the dye particles into the inside of the film. On the other hand, it is known that the trivalent chromate film contains polar water in the form of hydrate of trivalent chrome. The present inventors paying attention to this point have found that the dye particles containing a polar molecular compound can permeate easily into the inside of the film because intermolecular force based on dipole-dipole interaction acts on the dye particles from water contained in the film. Because the dye particles can easily permeate into the chromate film, the dye particles can be formed in the inside of the film so that the film can exhibit a color tone sufficiently even in the case where the film is a trivalent chromate film formed densely and good in corrosion resistance. The dye particles may further contain a compound (or chemical species including ions) in which chelating ligands are coordinate-bonded around each metal ion. By use of such a compound, a color tone peculiar to the metal ion as a color center can be exhibited.

The chromate processing is a kind of so-called chemical processing for replacing and accumulating chrome components while oxidizing and eluting an undercoat metal. Hence, in electroless chromate processing in which there is no electric power supplied from the outside, the undercoat metal has to be a metal capable of being eluted into the chromate bath. A zinc-based plating layer containing zinc as a main metal component can be formed on a surface of a plug metal component constituted by an iron-based material such as carbon steel in order to prevent corrosion. In this sense, the zinc-based plating layer is suitable as the undercoat metal for forming the chromate film. In this case, the zinc component eluted is often fetched into the chromate film. Incidentally, the zinc-based plating layer can be formed by a known zinc electroplating method or a known solution zinc plating method. On the other hand, when an electrolytic chromate processing method is used, the chromate film can be formed even in the case where the undercoat layer is a nickel plating layer containing nickel as a main metal component or the undercoat layer is an iron plating layer containing iron as a main metal component.

A first method for producing the chromate film-containing plug metal component according to the invention has the step of immersing the plug metal component in a mixing bath prepared by adding organic dye and/or organometallic composite dye into a chromate bath which is a mixture of trivalent chrome salt and a complexing agent for trivalent chrome and which contains 95% or more by mass of trivalent chrome with respect to the total chrome content. In this configuration, dye particles can be contained in the chromate film simultaneously with the formation of the chromate film.

A second method according to the invention has the steps of: immersing the plug metal component in a chromate bath which is a mixture of trivalent chrome salt and a complexing agent for trivalent chrome and which contains 95% or more by mass of trivalent chrome with respect to the total chrome content; and immersing the plug metal component in a coloring bath containing organic dye and/or organometallic composite dye. In this configuration, dye particles can permeate into the chromate film formed by the chromate bath, so that the dye particles can be dispersively contained in the chromate film. Incidentally, it is preferable that the particle size of the dye particles contained in the organic dye and/or organometallic composite dye is as small as possible, and that the particle size is set to be not larger than 50 nm after the dye particles are contained in the chromate film.

When a mixture of trivalent chrome salt and a complexing agent for trivalent chrome is used as the chromate bath, a trivalent chrome-based chromate film which is dense and thick and which can be hardly formed by a general chromate processing method can be formed. A method for forming such a chromate film has been disclosed in detail in German Patent Laid-Open DE-19638176A1.

Various types of chelating agents (dicarboxylic acid, tricarboxylic acid, oxyacid, hydroxyl group dicarboxylic acid, hydroxyl group tricarboxylic acid, etc.; for example, oxalic acid, malonic acid, succinic acid, glutaric acid, adipic acid, pimelic acid, cork acid, azelaic acid, sebacic acid, maleic acid, phthalic acid, terephthalic acid, tartaric acid, citric acid, malic acid, ascorbic acid, etc.) can be used effectively as examples of the complexing agent added into the chromate bath. Other complexing agents may be used instead. Complexing agents allowed to be used are described in the German Patent Laid-Open DE-19638176A1.

An organic dye having a component containing one kind of element or two or more kinds of elements selected from the group consisting of Na, Cl, H, O, C, N and S may be used as the organic dye contained in the mixing bath or the coloring bath. When such an organic dye is used, dye particles can be made to be contained in the chromate film well even in the case where the organic dye is added into the chromate bath or a chromate film containing dye particles dispersed therein can be formed even in the case where the organic dye is used singly as the coloring bath. Incidentally, an azo dye may be used as the organic dye.

An organometallic composite dye having a metal component containing one kind of element or two or more kinds of elements selected from the group consisting of Cr and Cu may be also used as the organic dye. Use of the organometallic composite dye is effective in accelerating fixation of dye particles to the trivalent chromate film. The amount of the metal component contained in each of the organometallic composite dye and water is preferably selected to be in a range of from 5 to 800 ppm. An example of the organometallic composite dye is phthalocyanine.

Figure 1:
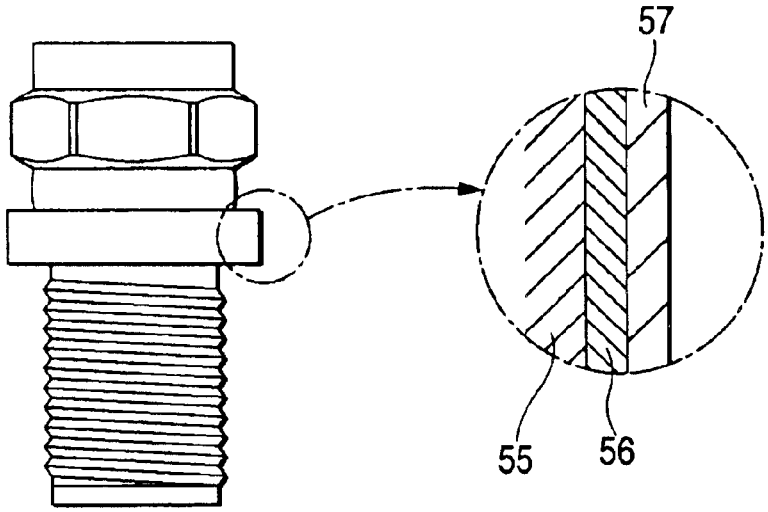
FIG. 1 is a view showing an example of a metal component for a chromate film-containing plug according to the invention.

[Description of the Reference Numerals and Signs]

| | |
|---|---|
| 2 | insulator (electrical insulator) |
| 3 | center electrode |
| 4 | ground electrode |
| 13 | terminal (metal component for spark plug) |
| 30 | gasket (metal component for spark plug) |
| 21 | heater |
| 24 | metal shell (metal component for glow plug) |
| 25 | current conduction terminal (metal component for glow plug) |
| 50 | mixing bath |
| 51 | dye particle |
| 55, 55' | metal shell (metal component for plug) |
| 56 | zinc-based plating layer |
| 57 | chromate film |
| 58 | chromate bath |
| 59 | coloring bath |
| 100 | spark plug |
| 200 | glow plug |

DETAILED DESCRIPTION OF THE INVENTION

Embodiments of the invention will be described below with reference to the drawings. FIG. 1 shows a metal shell 55 of a spark plug as an example of the chromate film-containing plug metal component according to the invention. In the metal shell 55, a zinc-based plating layer 56 is formed to prevent corrosion. The zinc-based plating layer 56 is formed by a known zinc electroplating method. For example, the thickness of the zinc-based plating layer 56 formed thus is set to be in a range of from about 3 μm to about 9 μm. If the thickness of the zinc-based plating layer 56 is smaller than 3 μm, the corrosion resisting effect of the layer 56 is little and it is undesirably impossible to keep corrosion resistance sufficient because of exhaustion of the zinc-based plating layer 56 due to sacrificial corrosion. If the thickness of the zinc-based plating layer 56 is larger than 10 μm, this specification is superfluous from the point of view of keeping corrosion resistance, and production efficiency is lowered because much time is required for plating. There is also a problem that plating peeling occurs easily when this component is combined with another component or subjected to a process such as a bending process.

Figure 2:
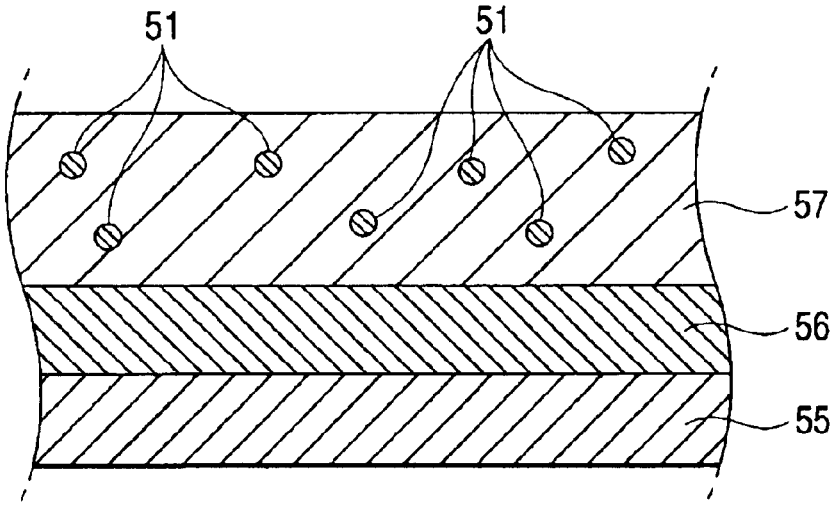
FIG. 2 is a conceptual view showing dye particles contained in a section of a chromate film.

A chromate film 57 is further formed on a surface of the zinc-based plating layer 56. The thickness of the chromate film 57 is set to be in a range of from 0.2 μm to 0.5 μm. The chromate film 57 contains 95% or more by mass of trivalent chrome with respect to the total chrome content. It is further preferable that all the chrome component contained in the chromate film is substantially constituted by a trivalent chrome component. As shown in FIG. 2, the chromate film 57 contains dye particles 51 dispersed therein. The dye particles 51 contains a polar molecular compound as a constituent component.

Figure 3:
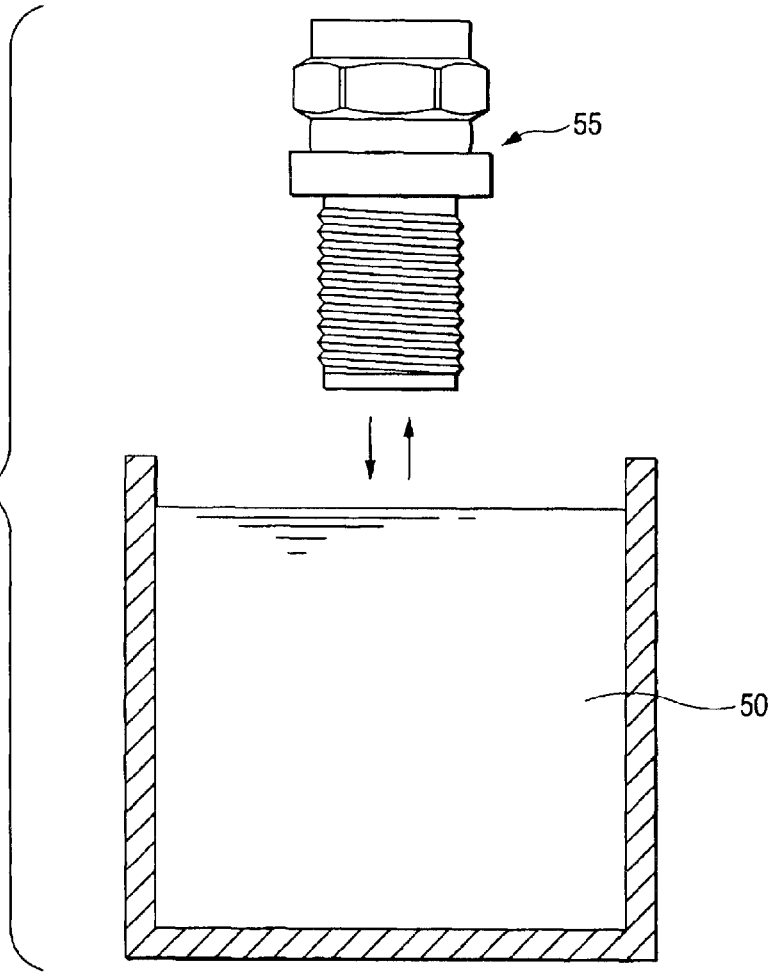
FIG. 3 is a conceptual view showing an example of a method for producing a metal component for a chromate film-containing plug according to the invention.

FIG. 3 shows an example of the method for producing a chromate film-containing plug metal component according to the invention. That is, a metal shell 55 containing a zinc-based plating layer 56 formed by a known zinc electroplating method to have a predetermined thickness is immersed in a mixing bath 50. The mixing bath 50 is prepared by adding organic dye and/or organometallic composite dye for coloring the chromate film 57 into a chromate bath for forming the chromate film 57. The same chromate bath and the same dye as described above may be used. Hence, the metal shell 55 can be covered with the chromate film 57 containing dye particles 51 dispersed therein as shown in FIG. 2. Incidentally, FIG. 3 is a conceptual view showing the step of forming the film. Although FIG. 3 shows the case where the metal shell 55 is simply immersed in the mixing bath 50, a known barrel processing method (in which the metal shell 55 is inserted in bulk into a liquid-permeable vessel and processed while the vessel is rotated in the mixing bath 50) may be practically used in order to improve throughput capacity.

A bath allowed to be set at a temperature of from 20° C. to 80° C. may be preferably used as the mixing bath 50. If the bath temperature is lower than 20° C., corrosion resistance cannot be maintained as well as coloring cannot be made sufficiently because the chromate film 57 cannot be formed sufficiently. On the other hand, if the bath temperature is higher than 80° C., corrosion resistance cannot be maintained sufficiently because water is vaporized from the mixing bath 50 so intensively that the chromate film 57 cannot be formed sufficiently. Moreover, the time required for immersing the metal shell 55 in the mixing bath 50 is preferably selected to be in a range of from 20 to 80 seconds. If the immersing time is shorter than 20 seconds, coloring cannot be made sufficiently as well as corrosion resistance cannot be maintained sufficiently because the immersing time is too short to form the chromate film 57. On the other hand, if the immersing time is longer than 80 seconds, corrosion resistance of the chromate film is influenced because the immersing time is too long. Moreover, a bath having pH selected to be in a range of from 1.8 to 2.4 may be preferably used as the mixing bath 50. If pH is lower than 1.8, the chromate film 57 formed is apt to be eroded because the chromate film 57 becomes too thick. On the other hand, if pH is higher than 2.4, coloring cannot be made sufficiently as well as the chromate film 57 is also apt to eroded undesirably because the chromate film 57 becomes too thin.

Figure 4:
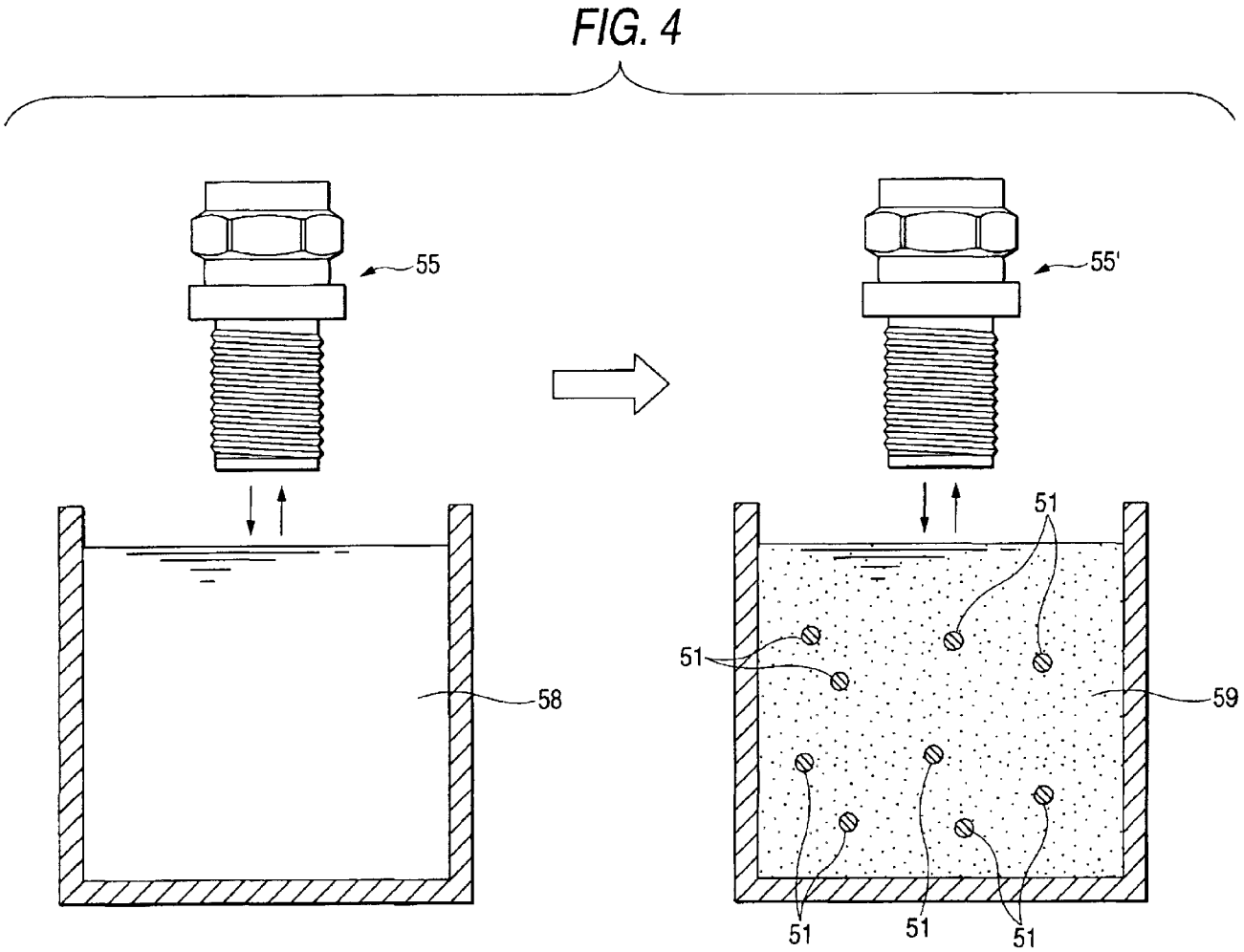
FIG. 4 is a conceptual view showing an example of a method for producing a metal component for a chromate film-containing plug according to the invention, other than the example of FIG. 3.
Figure 5:
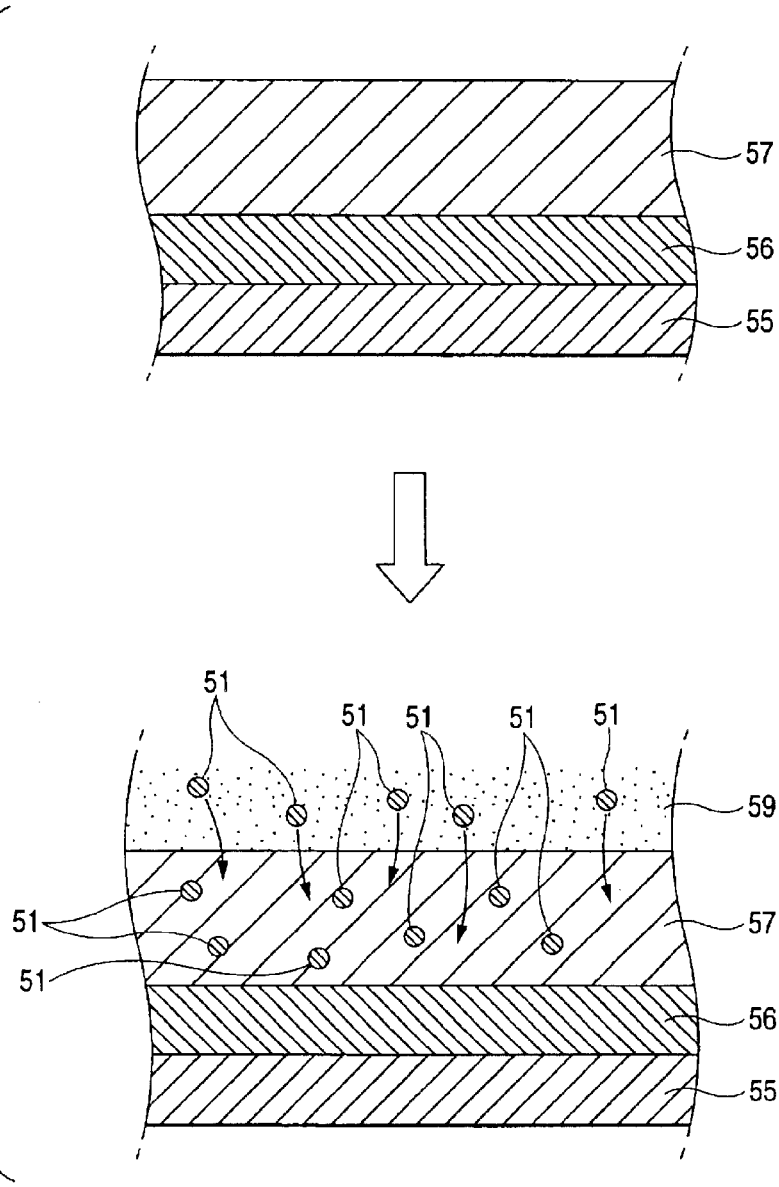
FIG. 5 is a conceptual view showing a state in which dye particles penetrate into a chromate film.

The form of dye particles 51 dispersively contained in a chromate film 57 may be achieved as shown in FIG. 4. That is, a metal shell 55 plated with zinc is immersed in the chromate bath 58 to thereby form a chromate film 57. Then, the metal shell 55' coated with the chromate film 57 is immersed in the coloring bath 59. The same chromate bath as described above may be used as the chromate bath 58. The coloring bath 59 is constituted by organic dye and/or organometallic composite dye as described above. The coloring bath 59 contains a large number of dye particles 51. Hence, as shown in FIG. 5, the dye particles 51 permeate the inside of the chromate film 57 which has been already formed. As a result, a chromate film 57 having dye particles 51 dispersed therein as shown in FIG. 2 can be formed. In this case, the metal shell 55' may be preferably immersed in the coloring bath 59 without any process of drying the chromate film 57 by hot air or the like after the formation of the chromate film 57. If the chromate film 57 is dried, the dye particles 51 can hardly permeate the chromate film 57 because water contained in the chromate film 57 is vaporized.

In the case where the metal shell 55' obtained by forming the chromate film 57 on the metal shell 55 is immersed in the coloring bath 59, the temperature of the chromate bath 58 may be preferably set to be in a range of from 20° C. to 80° C. and the time required for immersing the metal shell 55 in the chromate bath 58 may be preferably set to be in a range of from 20 seconds to 80 seconds in consideration of the corrosion resistance of the chromate film 57. As a result, a chromate film 57 having a thickness ranging from 0.2 $\mu$m to 0.5 $\mu$m can be formed and the corrosion resistance of the chromate film 57 can be kept good. This effect can be obtained when the pH of the chromate bath is further reduced to a range of from about 1.5 to about 3. Hence, this is effective in forming a chromate thick film because re-dissolution of the chromate film 57 formed can be suppressed moderately and dissolution of the undercoat metal layer (the zinc-based plating layer 56 mainly containing zinc in this embodiment) is accelerated.

A bath allowed to be set at a temperature of from 20° C. to 80° C. may be preferably used as the coloring bath 59. If the bath temperature is lower than 20° C., coloring cannot be made sufficiently because the permeability of the dye particles 51 into the chromate film 57 is lowered. On the other hand, if the bath temperature is higher than 80° C., corrosion resistance of the chromate film 57 is influenced undesirably because it is difficult to control the dye content, pH, etc. Moreover, a bath having pH set to be in a range of from 2 to 8 may be preferably used as the coloring bath 59. If the pH of the coloring bath 59 is lower than 2, the chromate film 57 formed is apt to be eroded by an acid component contained in the coloring bath 59. On the other hand, if the pH is higher than 8, the chromate film 57 is also apt to be eroded by an alkaline component contained in the coloring bath 59 undesirably. In addition, the present inventors have found that the permeability of the dye particles 51 is lowered when the pH of the coloring bath 59 is partial to the alkaline side.

The time required for immersing the metal shell 55' in the coloring bath 59 may be preferably set to be in a range of from 20 seconds to 80 seconds. If the immersing time is shorter than 20 seconds, good coloring cannot be made because the immersing time is so short that the dye particles 51 cannot permeate. On the other hand, if the immersing time is longer than 80 seconds, the permeability of the dye particles 51 does not change. The immersing time longer than 80 seconds exerts an influence on the corrosion resistance of the chromate film 57 undesirably as well as it brings lowering of production efficiency.

Figure 6:
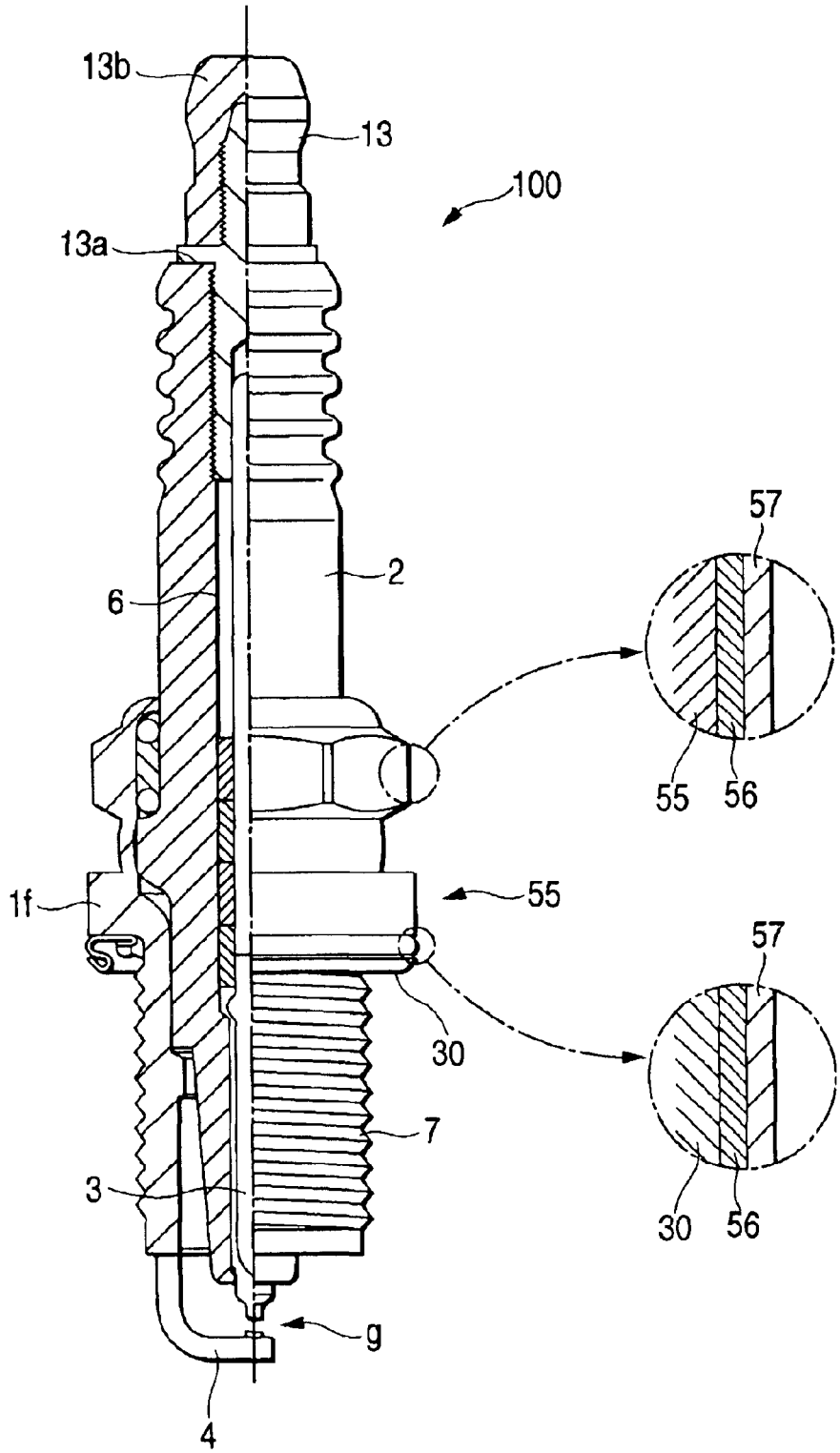
FIG. 6 is a view showing an example of a spark plug in which a metal component for a plug according to the invention is used.

The metal shell 55 is used in a spark plug shown in FIG. 6. The spark plug 100 shown in FIG. 6 has a center electrode 3, an insulator 2 provided outside the center electrode 3, a metal shell 55 provided outside the insulator 2, and a ground electrode 4 disposed opposite to the center electrode 3 so that a spark discharge gap g is formed between the ground electrode 4 and the center electrode 3. Further, a through-hole 6 is formed in the inside of the insulator 2 so that the center electrode 3 can be fitted into the through-hole 6 along the axial direction of the insulator 2. A terminal 13 is inserted and fixed into one end portion side of the through-hole 6, while the center electrode 3 is inserted and fixed into the other end portion side of the through-hole 6. The terminal 13 has a screw type terminal 13*a* thread-engaged with a female screw portion of the through-hole 6, and a terminal nut 13*b* thread-engaged with the screw type terminal 13*a*. Alternatively, the terminal 13 may be provided as an integral type terminal in which the screw type terminal 13*a* and the terminal nut 13*b* are integrated with each other. As described above, the metal shell 55 is a plug metal component according to the invention. A surface of the plug metal component is covered with a chromate film 57 according to the invention. A zinc-based plating layer 56 is formed as an undercoat metal layer in the plug metal component. Incidentally, the terminal 13 may be also a plug metal component according to the invention. The concept "terminal 13" may include the screw type terminal 13*a,* the terminal nut 13*b* and the integral type terminal.

The metal shell 55 is made of a metal such as carbon steel and shaped like a cylinder. The metal shell 55 constitutes a housing for the spark plug 100. A mount thread portion 7 for mounting the plug 100 on an engine block not shown is formed on an outer circumferential surface of the metal shell 55. A gasket 30 is fitted to a base end portion of the mount thread portion 7 formed on the outer circumferential surface of the metal shell 55. The gasket 30 is a ring-like component which is obtained by bending a metal plate material such as carbon steel. When the mount thread portion 7 is driven into a cylinder head side threaded hole, the gasket 30 is compressed axially between a flange-like gas seal portion 1*f* on the metal shell 55 side and an opening circumferential edge portion of the threaded hole. As a result, the gasket 30 is deformed so as to be collapsed, so that the gasket 30 plays a role of sealing a gap between the threaded hole and the mount thread portion 7. Incidentally, the gasket 30 may be also provided as a plug metal component according to the invention. That is, the gasket 30 also has a chromate film 57 formed in order to prevent corrosion and exhibits a color tone with dye particles 51. It is a matter of course that a chromate film 57 according to the invention can be formed also in any other metal component of the spark plug 100 which has not been described above.

Figure 7:
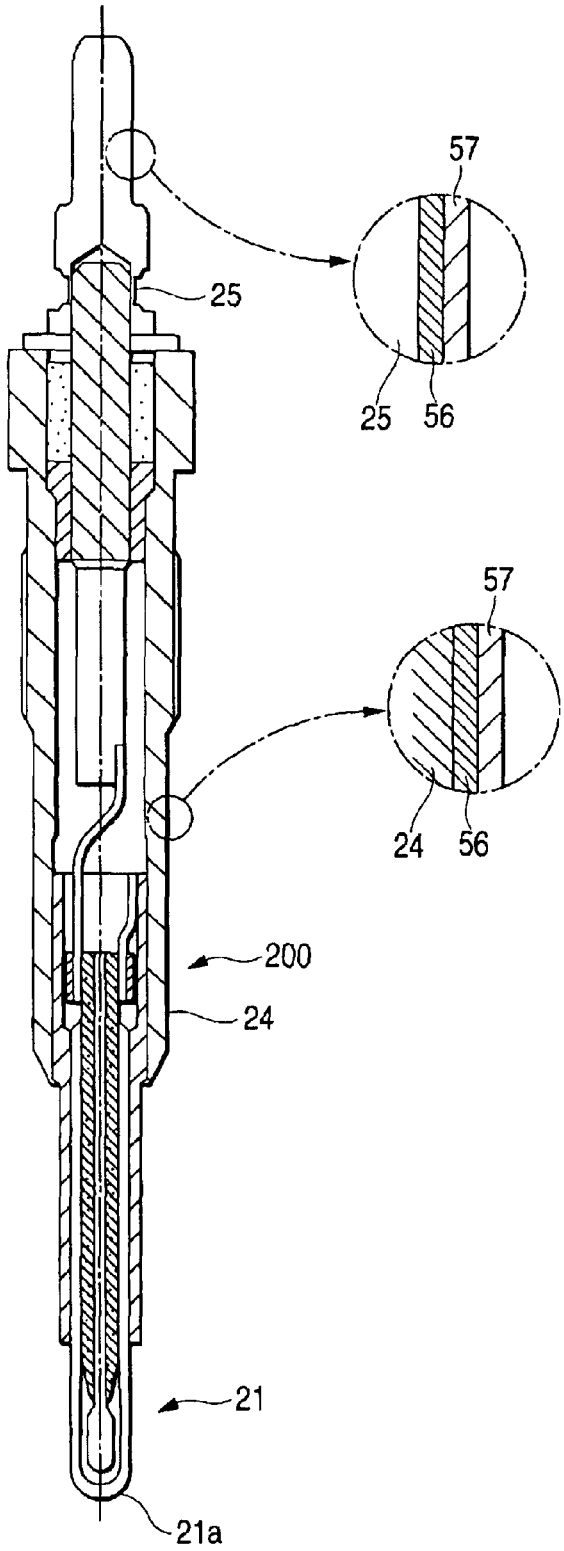
FIG. 7 is a view showing an example of a glow plug in which a metal component for a plug according to the invention is used.

The plug metal component according to the invention may be provided as a metal component used in a glow plug shown in FIG. 7. The glow plug 200 has a structure in which a resistance heater 21 is disposed in a metal shell 24 so that a forward end portion 21*a* of the resistance heater 21 is protruded from one end surface of the metal shell 24. Further, a current conduction terminal 25 for supplying electricity to the heater 21 is attached to the other end surface side of the metal shell 24 so as to be exposed. The plug metal component according to the invention can be used as the metal shell 24 and/or the current conduction terminal 25. At least one part of the surface of the metal shell 24 or the current conduction terminal 25 is covered with a chromate film 57 according to the invention. A zinc-based plating layer 56 is formed as an undercoat metal layer under the chromate film 57. It is a matter of course that a chromate film 57 according to the invention can be formed in any other metal component of the glow plug 200 which has not been described above. Alternatively, the glow plug may have a structure in which a current conduction terminal shaft for supplying electricity to the heater 21 is disposed so that a rear end portion of the current conduction terminal 25 is protruded from the other end surface of the metal shell and in which a nut for fixing a current conduction cable to the current conduction terminal 25 is thread-engaged with a male screw portion formed in the rear end portion of the current conduction terminal 25. In this case, the plug metal component according to the invention contains the nut in addition to the metal shell 24. Incidentally, it is a matter of course that the invention can be applied also to a metal component used in a plug having any other configuration than those of the spark plug 100 and the glow plug 200 shown in FIGS. 6 and 7.

EXAMPLES

Example 1

The effect of the invention was examined in connection with the metal shell 55 of the spark plug as a chromate film-containing plug metal component. Incidentally, though this example shows an embodiment of the invention, other changes may be made on the basis of the knowledge of those skilled in the art without departing from the spirit of the invention.

A cold-forging carbon steel wire SWCH8A defined in JIS-G3539-1999 was used as a material so that a metal shell 55 having a shape shown in FIG. 1 was produced by cold forging. Zinc electroplating using a known alkaline cyanide bath was applied to the metal shell 55 to thereby form a zinc-based plating layer 56 having a thickness of about 6 $\mu$m.

Then, 50 g of chromium (III) chloride ($CrCl_3.6H_2O$), 3 g of cobalt (III) nitrate ($Co(NO_3)_2$), 100 g of sodium nitrate ($NaNO_3$) and 31.2 g of malonic acid were dissolved in 1 liter of deionized water to thereby prepare a chromate bath 58. While the liquid temperature of the chromate bath was kept at 60° C. by a heater, an aqueous solution of sodium hydroxide was added into the chromate bath to thereby adjust the pH of the chromate bath to 2.0. Then, the metal shell 55 plated with zinc was immersed in the chromate bath 58 for 60 seconds to thereby form a trivalent chrome-based chromate film 57.

The metal shell 55 formed in this manner was immersed in a coloring bath 58 of the organic dye on the basis of the condition shown in Table 1. Specifically, 4 g of Top Zinc Color Process Y-5 made by Okuno Chemical Industries Co., Ltd. was used as the organic dye per 1 liter of the coloring bath. The Top Zinc Color Process Y-5 contains a polar molecular compound. Then, the color tone of the surface of the spark plug metal shell 55' and the color tone of the surface of the spark plug metal shell 55' (sample 11) obtained by immersion only in the chromate bath as a comparative example were compared with each other by eye observation. The case where no color tone difference was observed was evaluated as "X". The case where a color tone difference was confirmed but the color tone was light was evaluated as "Δ". The case where a sufficient color tone was provided was evaluated as "○". Incidentally, the color tone of the surface of the spark plug metal shell 55, was substantially yellow.

On the other hand, "5. Neutral Salt Water Spray Test Method" in a plating corrosion resistance test method defined in JIS-H8502-1988 was applied to each metal shell 55'. After this test was performed for 96 hours, the degree of white rust resulting from corrosion of the zinc-based plating layer 56 was examined by eye observation. The criterion for evaluation was set as follows.

○ (excellent): The rate of white rust to the total surface area was lower than 10%.

Δ (good): The rate of white rust to the total surface area was not lower than 10% and lower than 20%.

X (bad): The rate of white rust to the total surface area was higher than 20%.

In addition, the thickness of the chromate film 57 is actually measured on the basis of a section of each sample examined with an SEM. Incidentally, an Au thin film is formed on a surface of the chromate film 57 by a sputtering method in order to make it easy to observe the chromate film 57. Because the layer of the chromate film low in electric conductivity is dark in an SEM image, an image of the chromate film can be confirmed easily on the basis of contrast in the SEM image.

Table 1 shows results of the evaluation.

TABLE 1

| Sample No. | Bath Temp. (° C.) | Bath pH | Immersing time (sec) | Appearance Color Tone | Corrosion Resistance |
|---|---|---|---|---|---|
| 1 | 10 | 6 | 60 | Δ | ○ |
| 2 | 20 | | | ○ | ○ |
| 3 | 40 | | | ○ | ○ |
| 4 | 80 | | | ○ | ○ |
| 5 | 90 | | | ○ | Δ |
| 6 | 60 | 1 | | ○ | X |
| 7 | | 2 | | ○ | ○ |
| 8 | | 4 | | ○ | ○ |
| 9 | | 7 | | ○ | ○ |
| 10 | | 8 | | ○ | ○ |
| 11 | | 9 | | Δ | Δ |
| 12 | | 6 | 10 | Δ | ○ |
| 13 | | | 20 | ○ | ○ |
| 14 | | | 80 | ○ | ○ |
| 15 | | | 120 | ○ | Δ |
| 16 | | Non-coloring | | X | ○ |

It is obvious from Table 1 that the trivalent chromate film 57 can be colored by the producing method according to the invention. It is also obvious that good coloring can be made when the bath temperature, the pH of the bath, and the immersing time are selected to be not lower than 20° C., not higher than 8, and not shorter than 20 seconds, respectively. On the other hand, it is further obvious that corrosion resistance of the film is lowered when the bath temperature is higher than 80° C., the pH of the bath is not higher than 1 or the immersing time is longer than 90 seconds.

Example 2

A metal shell 55 of a spark plug was produced in the same manner as in Example 1. Zinc electroplating using an alkaline cyanide bath was applied to the spark plug metal shell 55 to thereby form a zinc-based plating layer 56 having a thickness of 6 $\mu$m.

Then, the chromate bath 58 was prepared in such a manner that 50 g of chromium(III) chloride ($CrCl_3.6H_2O$), 3 g of cobalt(II) nitrate ($Co(NO_3)_2$), 100 g of sodium nitrate ($NaNO_3$), 31.2 g of malonic acid and 4 g of organic dye (TOP ZINC COLOR PROCESS Y-5) were dissolved in 1 liter of deionized water. Incidentally, the pH of the bath was adjusted to 2.0 by addition of an aqueous solution of sodium hydroxide.

The spark plug metal shell 55 was immersed in the mixing bath 50 adjusted as described above, on the basis of the conditions shown in Table 2. Then, the color tone of the surface of the spark plug metal shell 55' and the color tone of the surface of the spark plug metal shell 55 (sample 7) obtained by immersion only in the chromate bath in Example 1 as a comparative example were compared with each other by eye observation. The case where no color tone difference was observed was evaluated as "X". The case where a color tone difference was confirmed but the color tone was light was evaluated as "Δ". The case where a sufficient color tone was provided was evaluated as "○". Incidentally, the color tone of the surface of the spark plug metal shell 55' was substantially yellow.

On the other hand, "5. Neutral Salt Water Spray Test Method" in a plating corrosion resistance test method defined in JIS H8502-1988 was applied to each spark plug metal shell 55' in the same manner as in Example 1. After this test was performed for 96 hours, the degree of white rust resulting from corrosion of the zinc-based plating layer 56 was examined by eye observation. The criterion for evaluation was as follows.

○ (excellent): The rate of white rust to the total surface area was lower than 10%.

Δ (good): The rate of white rust to the total surface area was not lower than 10% and lower than 20%.

X (bad): The rate of white rust to the total surface area was not lower than 20%.

In addition, the thickness of the chromate film 57 is actually measured on the basis of a section of each sample examined with an SEM. Incidentally, an Au thin film is formed on a surface of the chromate film 57 by a sputtering method in order to make it easy to observe the chromate film 57. Because the layer of the chromate film low in electric conductivity is dark in an SEM image, an image of the chromate film can be confirmed easily on the basis of contrast in the SEM image.

Table 2 shows results of the evaluation.

TABLE 2

| Sample No. | PH | Bath Temp. (° C.) | Immersing time (sec) | Appearance Color Tone | Corrosion Resistance | Chromate Film Thickness (μm) |
|---|---|---|---|---|---|---|
| 1 | 1.6 | 60 | 60 | ○ | Δ | 0.51 |
| 2 | 1.8 | | | ○ | Δ | 0.50 |
| 3 | 2.4 | | | ○ | ○ | 0.20 |
| 4 | 2.8 | | | ○ | ○ | 0.18 |
| 5 | 2.0 | 10 | | Δ | Δ | 0.18 |
| 6 | | 20 | | Δ | Δ | 0.21 |
| 7 | | 40 | | ○ | ○ | 0.32 |
| 8 | | 60 | | ○ | ○ | 0.41 |
| 9 | | 80 | | ○ | ○ | 0.50 |
| 10 | | 90 | | ○ | Δ | 0.57 |
| 11 | | 60 | 10 | Δ | Δ | 0.19 |
| 12 | | | 20 | ○ | ○ | 0.21 |
| 13 | | | 80 | ○ | ○ | 0.50 |
| 14 | | | 120 | ○ | Δ | 0.61 |
| 15 | | Non-Coloring | | X | ○ | 0.42 |

It is obvious from Table 2 that the trivalent chromate film 57 can be colored by the producing method according to the invention. It is also obvious that the trivalent chromate film becomes thinner than 0.2 μm so that corrosion resistance is lowered as well as coloring cannot be made sufficiently when the bath temperature is lower than 20° C., the immersing time is shorter than 20 seconds or the pH is higher than 2.4. It is further obvious that the trivalent chromate film becomes thicker than 0.5 μm to thereby lower corrosion resistance when the bath temperature is higher than 80° C., the immersing time is longer than 80 seconds or the pH is lower than 1.8. Accordingly, when the bath temperature, the immersing time and the pH are selected to be in a range of from 20° C. to 80° C., in a range of from 20 seconds to 80 seconds and in a range of from 1.8 to 2.4 respectively, good coloring can be made and a trivalent chromate film good in corrosion resistance can be formed.

Incidentally, the presence state of chrome in the chromate film 57 in each sample was examined by an X-ray photoelectron spectroscopy (XPS). As a result, it was confirmed that the chromate film 57 contained 100% by weight of trivalent chrome in the total chrome content, that is, no hexavalent chrome was detected. Incidentally, analysis by X-ray photoelectron spectroscopy was performed by an ESCALAB 220iXL apparatus (VG Scientific).

In each of samples 2, 5, 6 and 9 in Example 1 and samples 2 and 3 in Example 2 as an inventive product according to the invention, the color tone of the chromate film 57 was measured in numerical terms by a Lab color system. As a result, it was confirmed that the color tone of the chromate film had lightness L of 60 to 90, hue a of −40 to 40, hue b of 0 to 60, and chromaticness C of 10 to 60. Incidentally, measurement by the Lab color system was performed by using a spectrophotometer CM-3500d made by Minolta Co., Ltd. under the measurement conditions of light source: D65 2°, reference color system: spectral reflectance, regular reflection light processing: SCI, measurement diameter: Φ8 mm, target mask: Φ3 mm.

This application is based on Japanese Patent application JP 2002-265796, filed Sep. 11, 2002, and Japanese Patent application JP 2001-347451, filed Nov. 13, 2001, the entire content of those are hereby incorporated by reference, the same as if set forth at length.

What is claimed is:

1. a spark plug comprising:

a center electrode;

an insulator provided outside the center electrode;

a metal shell provided outside the insulator; and a ground electrode disposed opposite to the center electrode so as to form a spark discharge gap between the ground electrode and the center electrode, in a state in which the gasket is fitted to a base, end portion of a mount thread portion formed on an outer circumferential surface of the metal shell comprises:

a chromate film-containing plug metal component which is a metal component, wherein the metal component has a surface, at least part of the surface being coated with a chromate film comprising at least 95% by weight of trivalent chrome based on 100% by weight of a total chrome content in the chromate film, and the chromate film comprises dye particles.

2. A glow plug comprising:

a metal shell;

a resistance heater disposed in the metal shell so that a forward end portion of the resistance heater is protruded from one end surface of the metal shell; and a current conduction terminal through which electricity is supplied to the resistance heater and which is attached to the other end surface of the metal shell so as to be exposed;

wherein at least one of the metal shell and the current conduction terminal comprises:

a chromate film-containing plug metal component which is a metal component, wherein: themetal component has a surface, at least part of the surface being coated with a chromate film comprising at least 95% by weight of trivalent chrome based film; and the chromate film comprises dye particles.

* * * * *